US012030591B2

(12) United States Patent
Jones

(10) Patent No.: US 12,030,591 B2
(45) Date of Patent: Jul. 9, 2024

(54) RECESSED AND RETRACTABLE MOORING LINE ASSEMBLY

(71) Applicant: Damon Jones, Hull, GA (US)

(72) Inventor: Damon Jones, Hull, GA (US)

( * ) Notice: Subject to any disclaimer, the term of this patent is extended or adjusted under 35 U.S.C. 154(b) by 429 days.

(21) Appl. No.: 17/649,262

(22) Filed: Jan. 28, 2022

(65) Prior Publication Data

US 2022/0242526 A1 Aug. 4, 2022

Related U.S. Application Data

(60) Provisional application No. 63/143,332, filed on Jan. 29, 2021.

(51) Int. Cl.

| | |
|---|---|
| ***B63B 21/20*** | (2006.01) |
| ***B63B 21/04*** | (2006.01) |
| *B63B 21/00* | (2006.01) |

(52) U.S. Cl.

CPC ..... *B63B 21/20* (2013.01); *B63B 21/04* (2013.01); *B63B 2021/004* (2013.01); *B63B 2021/203* (2013.01)

(58) Field of Classification Search

CPC ..... B63B 21/00; B63B 21/04; B63B 21/20; B63B 2021/004; B63B 2021/203

USPC ..... 114/230.1, 230.23

See application file for complete search history.

(56) References Cited

U.S. PATENT DOCUMENTS

| | | | | |
|---|---|---|---|---|
| 1,811,400 | A * | 6/1931 | McClellan | B63B 21/045 114/230.23 |
| 4,697,537 | A | 10/1987 | Smith | |
| 6,095,075 | A | 8/2000 | Gordon et al. | |
| 7,325,509 | B2 * | 2/2008 | Gordon | B63B 21/04 114/230.1 |
| 7,694,639 | B2 | 4/2010 | Gordon et al. | |
| 8,413,599 | B2 * | 4/2013 | Underwood | B63B 21/04 114/230.23 |
| 9,694,878 | B2 | 7/2017 | Johnston | |
| 9,776,688 | B1 | 10/2017 | Underwood | |

(Continued)

FOREIGN PATENT DOCUMENTS

| | | | |
|---|---|---|---|
| EP | 2424774 | A2 | 3/2012 |
| WO | WO2010125335 | A2 | 11/2010 |

OTHER PUBLICATIONS

Boat Nation, Retractable Mooring Line, www.boatnation.com/list/profile/boatshows-tournaments-other-events/boat-trade-shows-2/retractable-mooring-line, accessed Jan. 25, 2021, pp. 1-5.

*Primary Examiner* — Lars A Olson

(74) *Attorney, Agent, or Firm* — Grady K. Bergen; Griggs Bergen LLP

(57) ABSTRACT

A recessed and retractable mooring line device includes a housing having a mooring head that is configured for projecting through an opening or recess of a mounting structure so that an upper surface of the mooring head does not project from an outer surface of the mounting structure. A reel assembly is coupled to the housing and positioned below the mooring head to take up a flexible mooring line. The reel assembly includes a rotatable spool for winding the line. A ratchet wheel and spool that is engaged by a pawl prevents rotation of the ratchet wheel and spool when engaged. A moor head assembly that includes a pawl actuator actuates the pawl. An actuator lock of the moor head assembly engages the pawl actuator to keep it engaged with the pawl. A line anchor is used for securing to an end of the mooring line.

20 Claims, 9 Drawing Sheets

(56) References Cited

U.S. PATENT DOCUMENTS

| | | | |
|---|---|---|---|
| 2003/0070599 | A1 | 4/2003 | Kiss |
| 2017/0120987 | A1 | 5/2017 | Yost |

* cited by examiner

RECESSED AND RETRACTABLE MOORING LINE ASSEMBLY

CROSS-REFERENCE TO RELATED APPLICATIONS

This application claims the benefit of U.S. Provisional Patent Application No. 63/143,332, filed Jan. 29, 2022, which is herein incorporated by reference in its entirety for all purposes.

TECHNICAL FIELD

The invention relates to mooring devices for mooring boats or other watercraft.

BACKGROUND

Traditionally when mooring a boat or watercraft to a dock or other structure, the boat is tied or tethered to the dock or structure by tying one end of a rope or line to the boat and tying the other end of the rope or line to a cleat attached to the dock, pier or other mooring structure. An example of a conventional cleat 10 used for such purposes is depicted in FIG. 1.

Conventional cleats, such as the cleat 10, are typically mounted to peripheral areas of the dock or mooring structure where they are readily accessible. The number, location and configuration of such cleats is usually dependent upon the configuration of the dock and how it is to be utilized Boats or other watercraft also utilize such cleats, such as the cleat 10. The cleats are typically mounted along the peripheral edges of the boat, such as the deck, gunwale, bow, transom, etc., to make them easily accessible to the user when attaching the rope or line to moor the boat to the dock.

Conventional cleats come in various shapes, sizes, and materials, but are usually of a basic design that is very similar to the cleat 10 of FIG. 1. Such cleats are normally secured to the dock or boat using a bolt or lag screws that penetrate the surface to which the cleat is mounted.

By nature of their design and application, conventional cleats present several problems even when they are properly installed and utilized. Because the cleat projects from the surface on which it is mounted, the cleat may constitute a tripping hazard. This is particularly true when the cleat is mounted on a deck of a dock or boat where people may walk. The cleat also permanently occupies space and forms an obstruction so that the area where the cleat is mounted cannot be used for any other purpose. Moreover, because conventional cleats are mounted to the dock/boat using screws/bolts that penetrate the mounting surface, the structural integrity and load carrying capacity of the cleat can be diminished as the mounting surface or structure may degrade from continuous exposure to the elements. Furthermore, when the cleat is not in use, the rope or line used to moor the boat to the dock is typically removed from the cleat and stored separately from the cleat so that it is not misplaced. If the rope or line is not stored in an adequate environment, it may also degrade from exposure from the elements.

Accordingly, improvements to cleats or mooring devices are needed to overcome these and other shortcomings.

BRIEF DESCRIPTION OF THE DRAWINGS

For a more complete understanding of the embodiments described herein, and the advantages thereof, reference is now made to the following descriptions taken in conjunction with the accompanying figures, in which.

DETAILED DESCRIPTION

Figure 1:
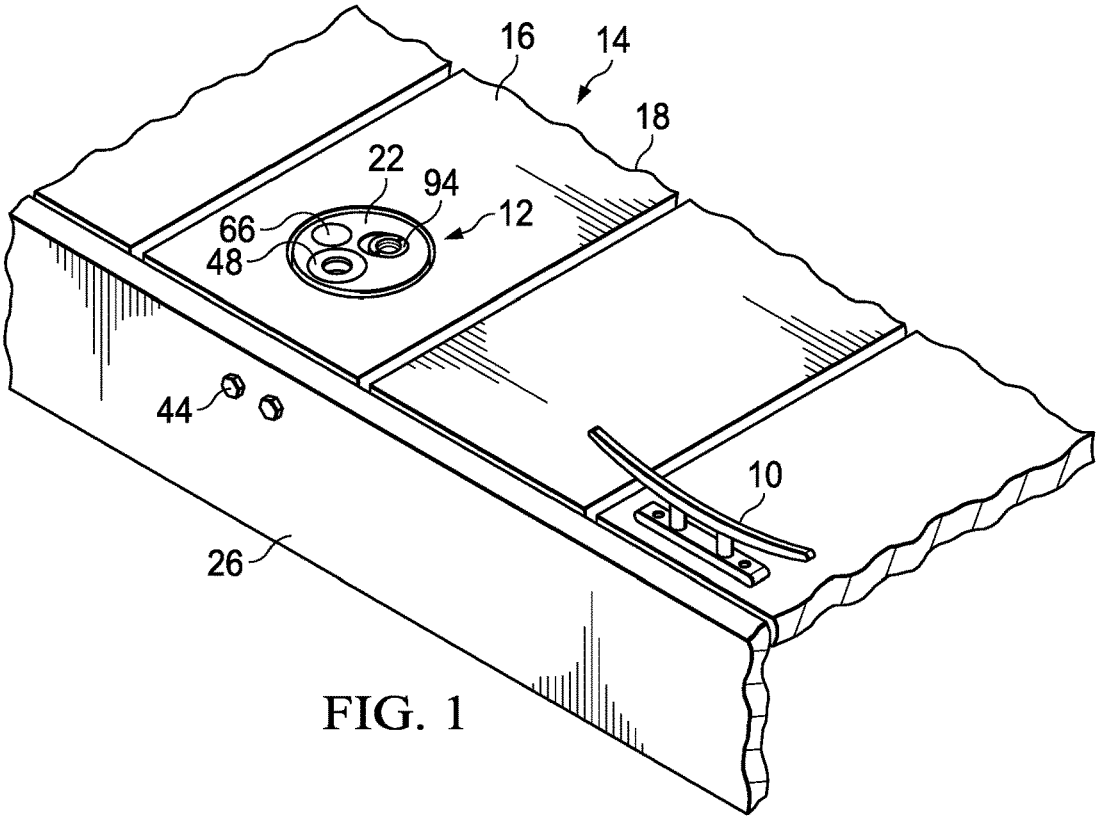
FIG. 1 is a perspective view of a dock employing a mooring device constructed in accordance with particular embodiments of the invention.

Referring to FIG. 1, a recessed mooring line device 12 is shown in use with a dock or other mooring structure 14. The mooring line device 12 is particularly well suited for use for mooring boats or watercraft having an overall length of 40 feet or less. The dock or mooring structure 14 is representative of any structure that may be used for mooring or securing a boat or other watercraft. Such structures may include, but are not limited to, a dock, a floating dock, a pier, a deck, a gunwale, a bow, a transom, etc. Such structures may be part of dock or pier that is connected to land and extends over a body of water or may be part of a boat or water vessel. In the following discussion, the structure 14 is described as being part of a dock but it should be understood that it is not so necessarily limited to a dock and may be used on a boat or watercraft or other structure on or near a body of water.

As shown, the mooring line device 12 is flush or level or substantially flush or level with a surrounding surface 16 of the dock 14 so that it does not project above the surface 16, as does the conventional cleat 10 of FIG. 1. As used herein, the expression "substantially flush or level" with respect to the mooring line device 12 or its components should be construed to mean, unless expressly stated otherwise, that it projects or is recessed within ⅛ inch or less from the surrounding surface 16. The surface 16 may be formed by the outward facing surface of an outer facing member 18 of the dock 14. The outer facing member 18 may be decking of the dock 14, which may be a flat plank or board of the dock 14, which may be one of many, and which also forms a deck or flat walking or support surface of the dock 14.

Figure 2:
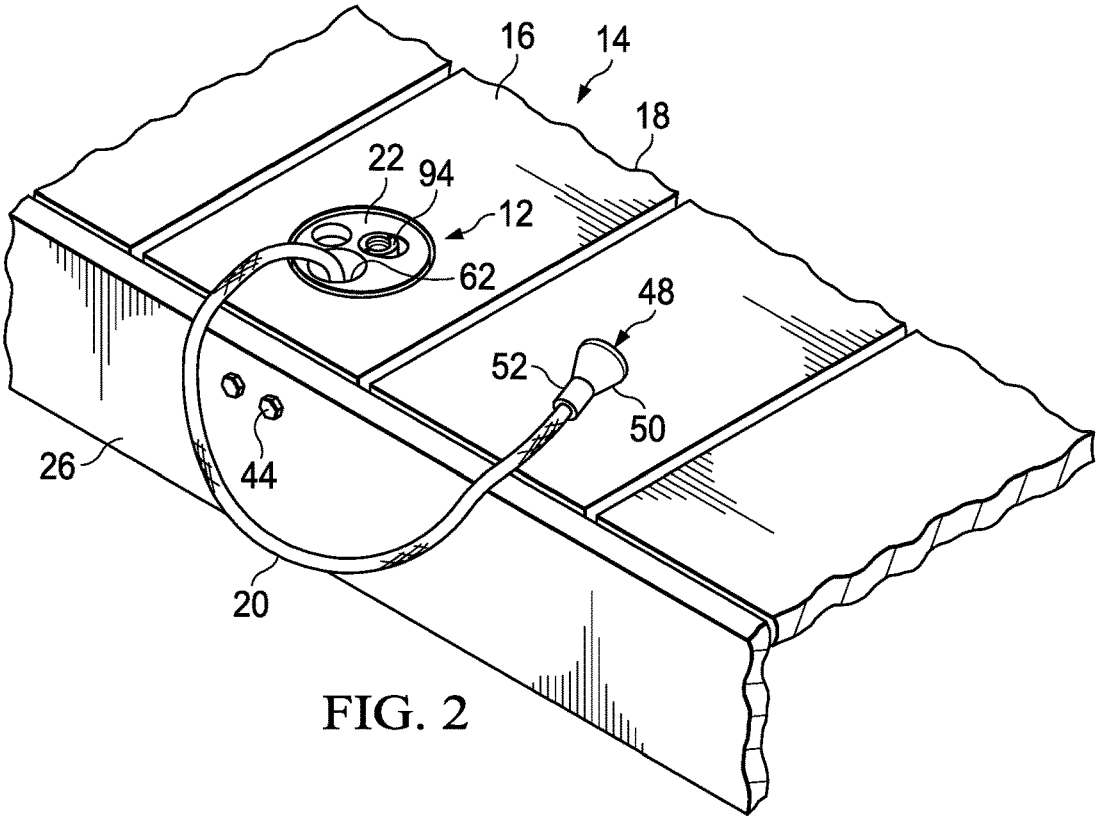
FIG. 2 is a perspective view of the dock and mooring device of FIG. 1, with a mooring line of the mooring device shown withdrawn from the mooring device.

Referring to FIG. 2, the mooring line device 12 is provided with a rope or mooring line 20 that may be selectively pulled or drawn from the mooring line device 12 for use in mooring a boat or watercraft. The mooring line 20 is also stored upon the device 12 and is retractable or withdrawn by the device 12 so that it is stored on the mooring device 12 and out of the way when not in use. The mooring line 20 is that which may have a diameter of ½ inch or less. In many applications, the line or rope 20 will be a ⅜-inch line or rope for use with boats or watercraft having an overall length of 30 feet or less. The line or rope 20 may be a conventional three-strand rope, but it has been found that the smoother braided-type lines or ropes are particularly well suited for use with the mooring line device 12. The mooring line 20 will typically have a length of from 8 feet to 20 feet but may be shorter or longer than this in certain applications.

Figure 3:
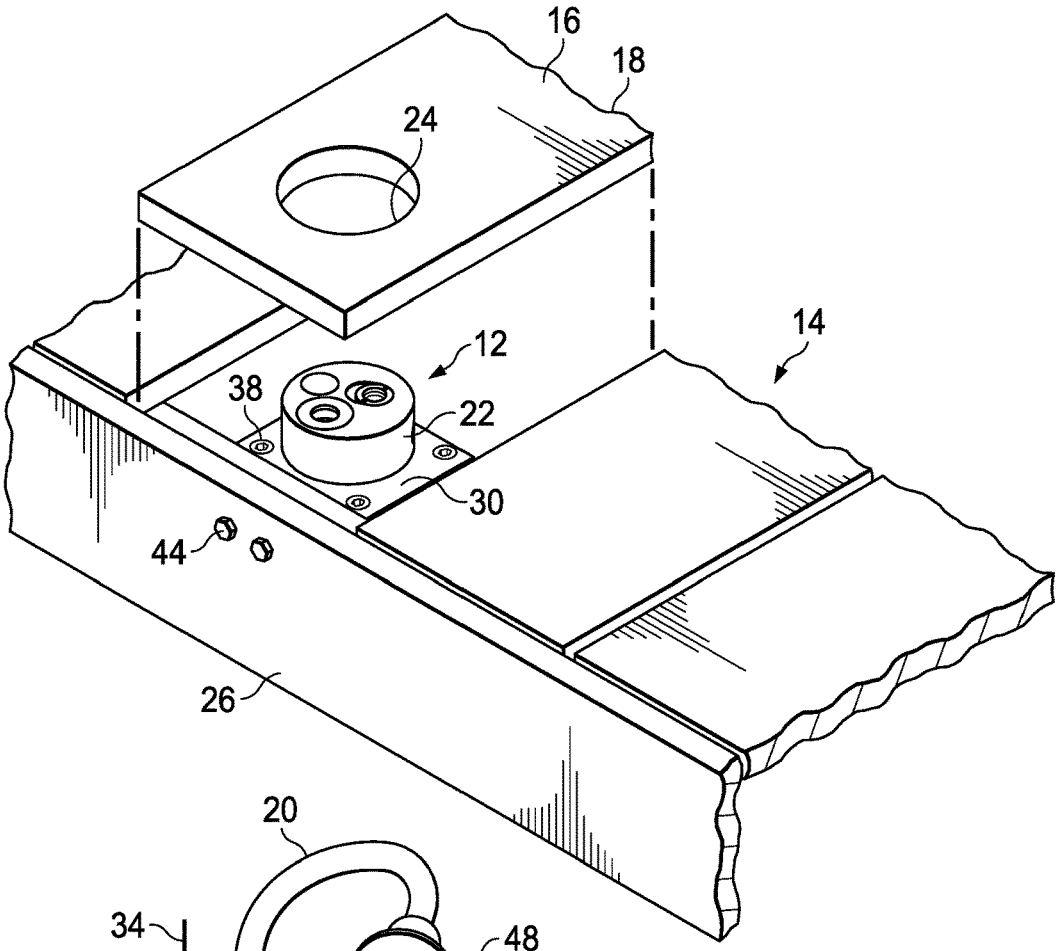
FIG. 3 is a perspective view of the dock and mooring device of FIG. 1, shown with a plank of the dock exploded away from the dock and mooring device.

FIG. 3 shows the plank or member 18 exploded away to reveal a mooring head 22 that is configured projecting through an opening 24 formed in the plank 18. As shown, the mooring head 22 is generally cylindrical in shape having a generally circular transverse cross section or upper surface, although it may be non-cylindrical, as well. Non-cylindrical shapes may include those with oval, square, rectangular, or polygonal cross sections. The opening 24 formed in plank 18 is shaped and configured to receive the mooring head 22 so that it is closely received therein.

The plank 18 is secured or mounted to substructure frame or support 26, such as a joist, side band, end band, etc., of the dock 14. Such support substructure 26 may be oriented vertically or at right angles to the plank 18 and those planks forming the deck or walking surface of the dock 14.

Figure 4:
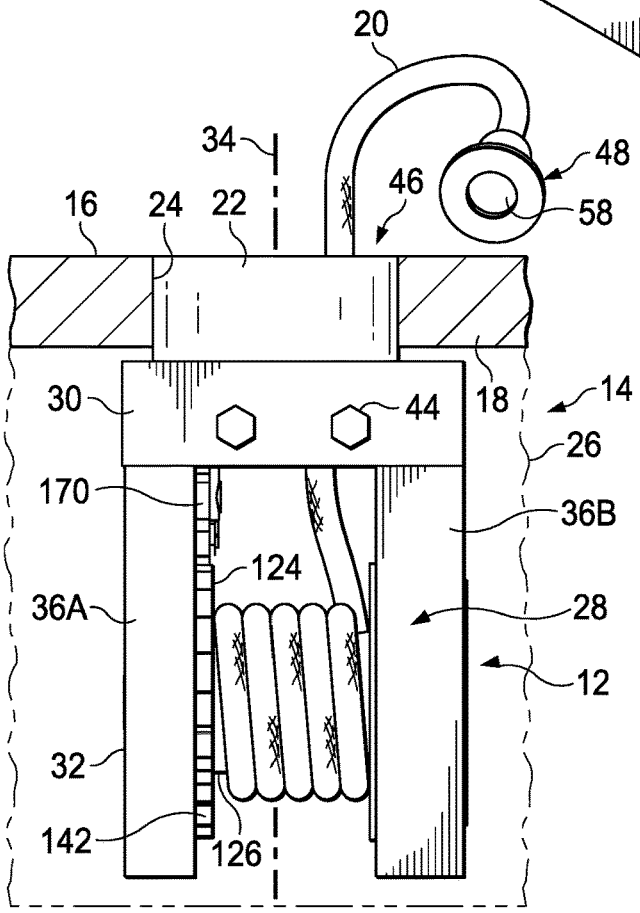
FIG. 4 is an elevational view of the mooring device of FIG. 1.

Referring to FIG. 4, the mooring head 22 forms a portion of an overall housing 28 of the device 12 for housing the various components of the mooring line device 12. The housing 28 includes the cylindrical mooring head 22, a mooring head base 30 from which the mooring head 22 projects, and a reel assembly housing 32. The various components of the housing 28 may be formed from strong and durable corrosion resistant metal materials, such as stainless steel, aluminum, brass, etc. The components may also be surface treated or coated with a protective coating to resist corrosion. In one particular embodiment, the housing 28 or portions thereof may be formed from 6061 aluminum.

Figure 5:
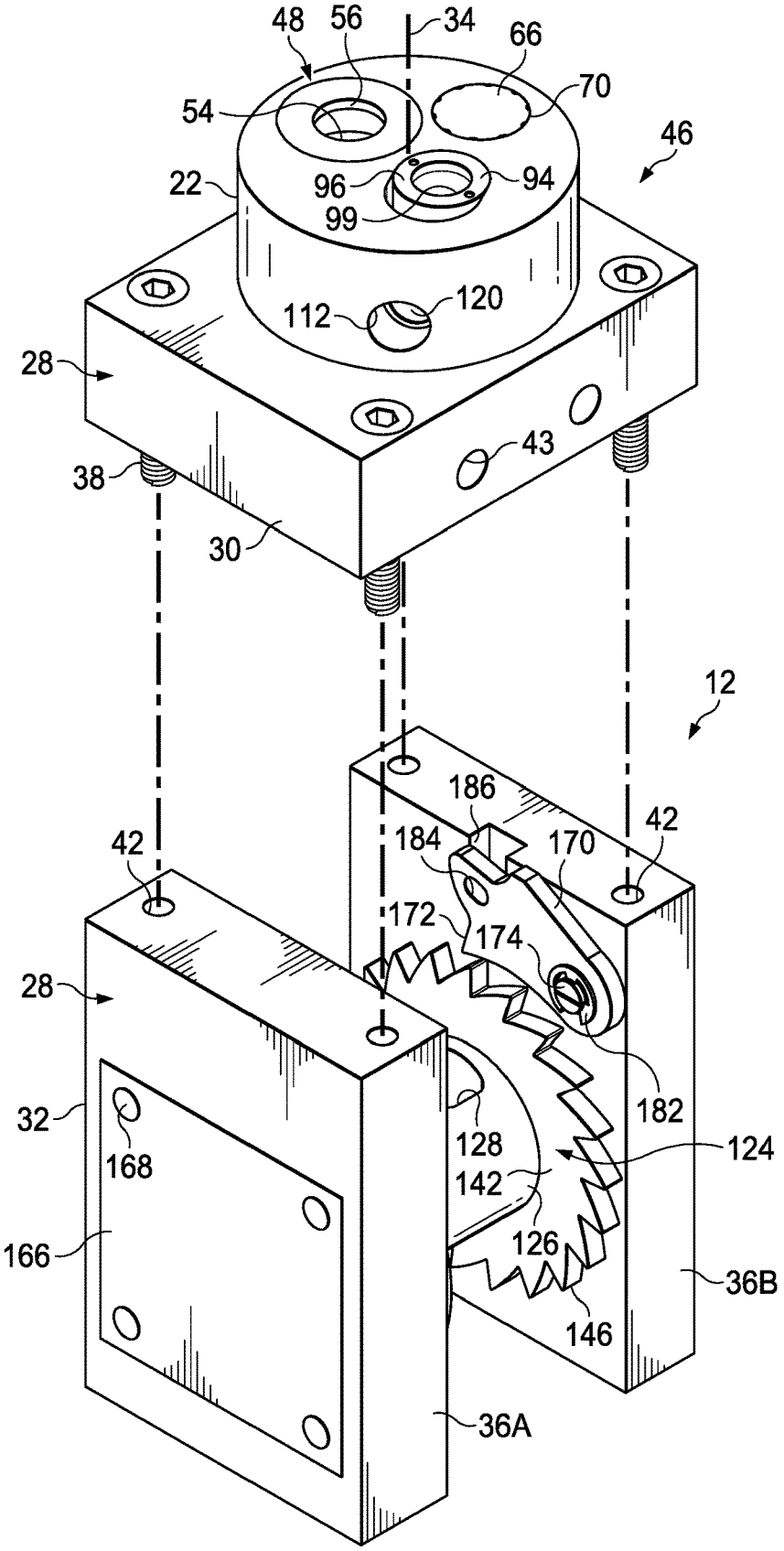
FIG. 5 is a perspective view of the mooring device of FIG. 4, shown with a mooring head assembly of the mooring device exploded away from a reel assembly of the mooring device.

As shown in FIG. 5, the mooring head 22 and mooring head base 30 may be formed from a single machined block of material, such as 6061 aluminum. The mooring head base 30 is configured as a flat square or rectangular block of material that is horizontally oriented or perpendicular to a central axis 34 of the mooring line device 12 that passes through the center of the cylindrical mooring head 22.

The reel assembly housing 32 is formed from two separate laterally spaced apart rectangular blocks or members 36A, 36B of material that are vertically oriented or parallel to the axis 34. As shown, the members 36A, 36B of the reel assembly housing 32 are coupled to the mooring head base 30 through bolts 38 or other fasteners that extend through apertures 40 (FIG. 6) formed through the thickness of the base 30 at each corner from its upper end and are received in threaded apertures 42 (FIG. 5) formed in the upper end of the reel assembly housing blocks 36A, 36B. The mooring head base 30 covers the upper end of the housing 32. In some instances, the reel assembly housing 32 may be provided with panels or plates (not shown) on either side of the housing blocks 36A, 36B and at the lower end the housing blocks 36A, 36B, so that the reel assembly housing 32 provides a complete enclosure for covering and protecting the interior of the housing 32 on all sides.

The mooring head base 30 is also provided with two or more laterally spaced apart apertures 43 that extend transversely across the width of the base 30 from one side to the other for receiving mounting bolts or other fasteners 44, such as carriage bolts, which are used to secure the mooring line device 12 to the frame substructure 26, such as the joist 26 shown in FIGS. 3 and 4.

The planks 18 may cover all or a portion of the substructure 26 so that the fasteners 44 or portions thereof are not readily accessible and are housed or protected by the plank 18. The plank 18 with opening 24 also covers the bolts 38 used to couple the mooring head assembly 12 to the reel assembly housing 32. The mooring line device 12 thus has a greater degree of protection from the environment since the plank 18 covers the various fasteners used to couple the components of the device 12 and to mount the mooring device to the substructure 26. This also protects the device 12 from tampering or unauthorized removal of the mooring device 12 because the mounting fasteners 44 cannot be readily accessed without first removing the plank 18.

Each of the various members forming the housing 28 should be of a sufficient strength and thickness to provide sufficient strength and support for the mooring line device 12 to withstand those forces that would typically be encountered during mooring of a boat or watercraft. In some embodiments, the blocks of material, such as aluminum, forming the mooring head 22, mooring head base 30, and reel assembly housing members 36A, 36B may have a thickness of ½ inch, ¾ inch, 1 inch, 1¼ inch, 1½ inch, 1¾ inch, 2 inches, 2¼ inches, 2½ inches or more. The height or thickness of the mooring head 22 should be sufficient to project through the thickness of plank 18 so that it is accessible and with projecting significantly above the plank 18 so that it is generally flush with or slightly recessed from the outer or upper surface 16 of the plank 18.

Figure 6:
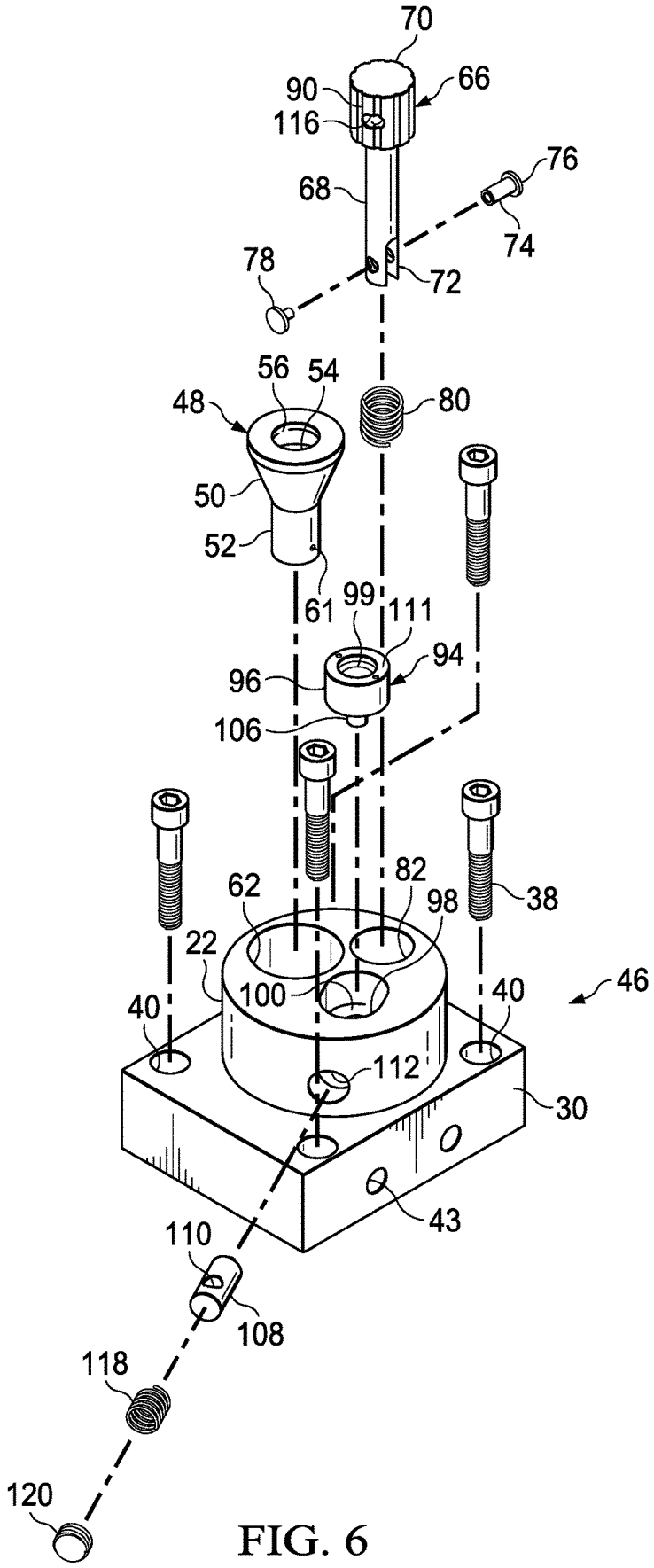
FIG. 6 is a perspective view of the mooring head assembly of the mooring device of FIG. 4.

FIG. 6 shows a mooring head assembly 46 of the device 12. The various components of the mooring head assembly 46 are coupled to and/or housed in the mooring head 22 and mooring head base 30, which form part of the overall housing 28 of the device 12, as previously described. As shown, the mooring head assembly 46 includes a line anchor 48 that is accessible from the exposed upper surface of the mooring head 22 for securing to an end of a rope or line. The line anchor 48 couples to one end of the mooring line 20.

Figure 7:
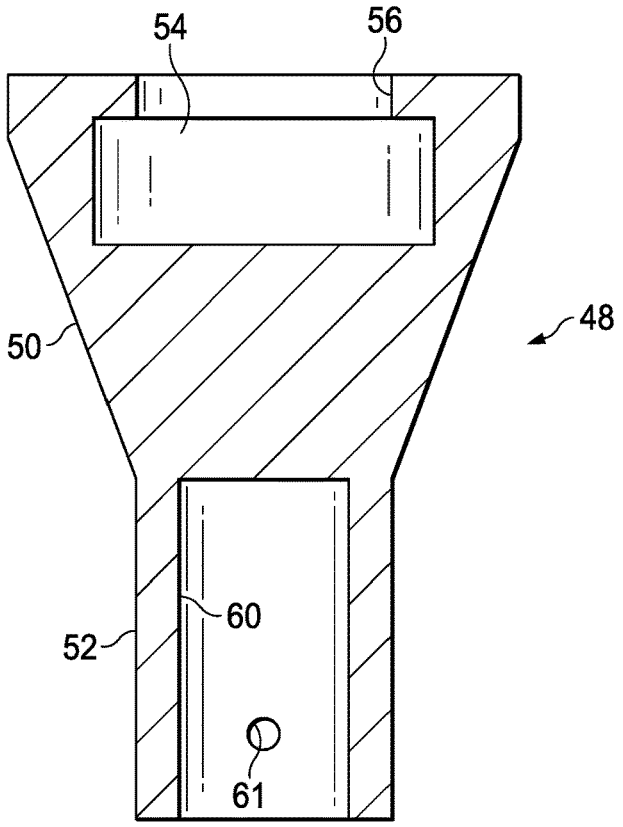
FIG. 7 is an elevational cross-sectional view of a line anchor of the mooring head assembly of FIG. 4.

As shown in FIG. 7, the line anchor 48 is shown as having a frustoconical upper portion 50 that is joined at its narrow end to a cylindrical lower portion 52, which extends therefrom. The upper portion 50 may be a solid body having a circular recess or opening 54 in its upper surface that is sized and configured so that one may insert one or more fingers into the opening 54. An inwardly projecting annular lip 56 may be provided along the perimeter of the opening 54 at its upper end to facilitate manually grasping of the line anchor 48.

In some embodiments, a lighting element 58 (FIG. 5), such as a battery powered LED light, may be located and housed within the opening 54. The light may be activated by movement of one or more of the components of the mooring device 10 or may have a dedicated switch to turn the light on or off. The light 58 may also include a lens that fits within and covers the opening 54, with the lens being flush with the upper end of the anchor 48. This may prevent debris from filling the recess or opening 54 in some embodiments.

The cylindrical lower portion 52 of the line anchor 48 is also provided with a cylindrical recess 60 that extends from the lower end of the line anchor 48 and is sized and configured for receiving one end of the rope or line 20. One or more set screw apertures 61, which may be threaded apertures, may be provided in the wall of the cylindrical portion 52 that communicate with the recess 60 for receiving set screws (not shown) that engage the end of the line 20 for securely coupling the end of the rope 20 to the line anchor 48. Other coupling means, such as a two part epoxy, or a combination of different coupling means may also be used for securing the end of line 20 to the line anchor 48.

The line anchor 48 or portions thereof may be formed from corrosion resistant metal materials, such as stainless steel, aluminum, brass, etc. In certain applications, the line anchor 48 is formed from non-metal materials. These may include durable plastic or polymeric materials, such as an acetyl homopolymer (e.g., DELRIN® acetyl homopolymer).

Figure 8:
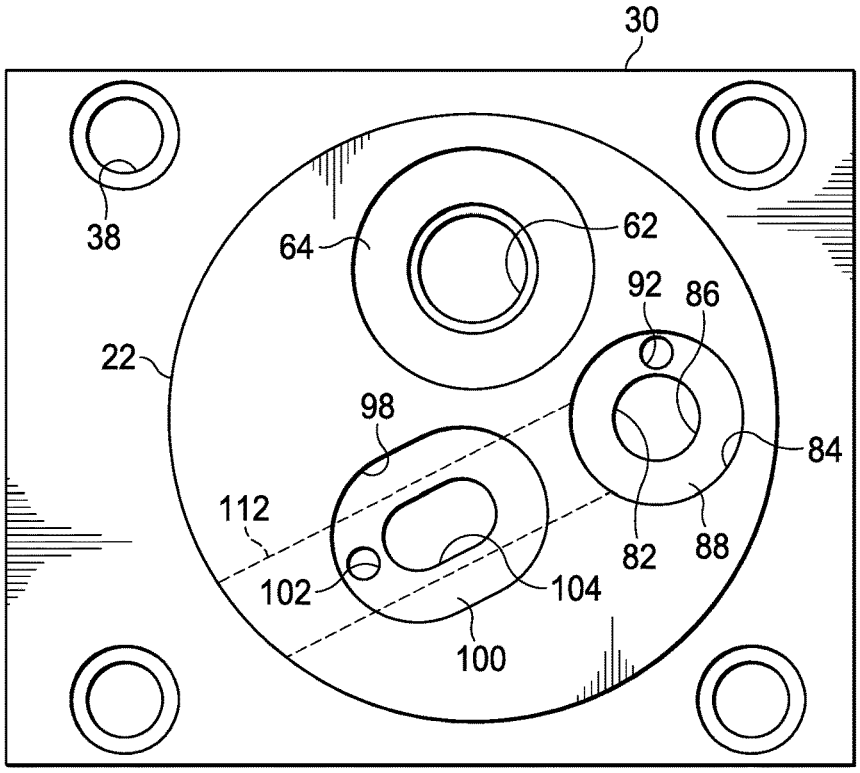
FIG. 8 is a top plan view of the mooring head assembly of FIG. 4.

Referring to FIG. 8, a line aperture 62 is formed in the mooring head 22 and extends through mooring head base 30 to allow the passage of the rope or line 20 through the aperture 50 to the reel assembly housing 32. The line aperture 62 is shaped and configured to closely receive the line anchor 48 and to prevent the line anchor 48 from passing through the line aperture 62. This may be through an annular shoulder or other radially inward projection located within the aperture 62. In the embodiment shown, the upper portion 64 of the aperture 62 is gradually tapered inward from the upper surface of the mooring head 22 so that it has a frustoconical shape corresponding to the frustoconical upper portion 50 of the line anchor 48. This causes the upper portion 50 of the line anchor 48 to be closely received in the frustoconical recessed portion 64 of the line aperture 62 when the line anchor 48 is seated therein. This configuration ensures that the end of the line 20 and line anchor 48 are not pulled through the aperture 62 and also facilitates proper alignment and seating of the line anchor 48 within the aperture 62.

The mooring head assembly 46 also includes a pawl actuator 66 that is accessible from the exposed upper surface of the mooring head 22. The pawl actuator 66 is configured as an elongated member or rod 68 having a head or button 70 at its upper end. The actuator rod 68 and head 70 are shown as each having a cylindrical or generally cylindrical configuration that are coaxial with one another. The head 70 has a larger diameter than the diameter of the rod 68 so that the lower end of the head 70 forms a radially outward projecting annular shoulder located above the upper end of the rod 68. The lower end of the rod member 68 is forked or provided with a yoke or two spaced apart provided arms 72 with openings for receiving and supporting a transverse pin or post 74, which may be formed from a Chicago screw-type fastener having a female nut portion 76 with the shank of the nut 76 forming the pin or post 74. The pin or post 74 provides a smooth outer bearing surface. A cooperating male screw portion 78 engages the internally threaded nut portion 76 for securing pin or post 74 to the arms 72 of the pawl actuator 66 and to a pawl of a reel assembly, which is described later.

A spring or biasing member 80 is provided with the pawl actuator 66 for biasing the pawl actuator to one of a depressed or a released position. In the embodiment shown, the biasing member 80 constitutes a helical coiled compression spring that is centered around and positioned upon the pawl actuator rod 68 and biases the pawl actuator 66 toward a raised released position. The spring 80 is sized so that its upper end abuts against the lower surface or shoulder formed by the head 70 and is thereby retained on the rod 68 at its upper end.

The pawl actuator 66 or portions thereof may be formed from corrosion resistant materials, such as stainless steel, aluminum, brass, etc. In many applications, the pawl actuator 66 is formed from a durable plastic or polymeric material, such as an acetyl homopolymer (e.g., DELRIN® acetyl homopolymer). The coiled spring 80 may be formed from stainless steel, such as 316 stainless steel.

A pawl actuator aperture or passage 82 is formed in the mooring head 22 and extends through mooring head base 30 to allow the passage of the actuator rod 68 through the aperture 82. The actuator rod 68 has as sufficient length so that the lower end of the rod 68 with the arms 72 that carry the pin 74 extends beyond the aperture 82 when the pawl actuator 66 is in both the fully depressed and fully released positions.

Figure 9:
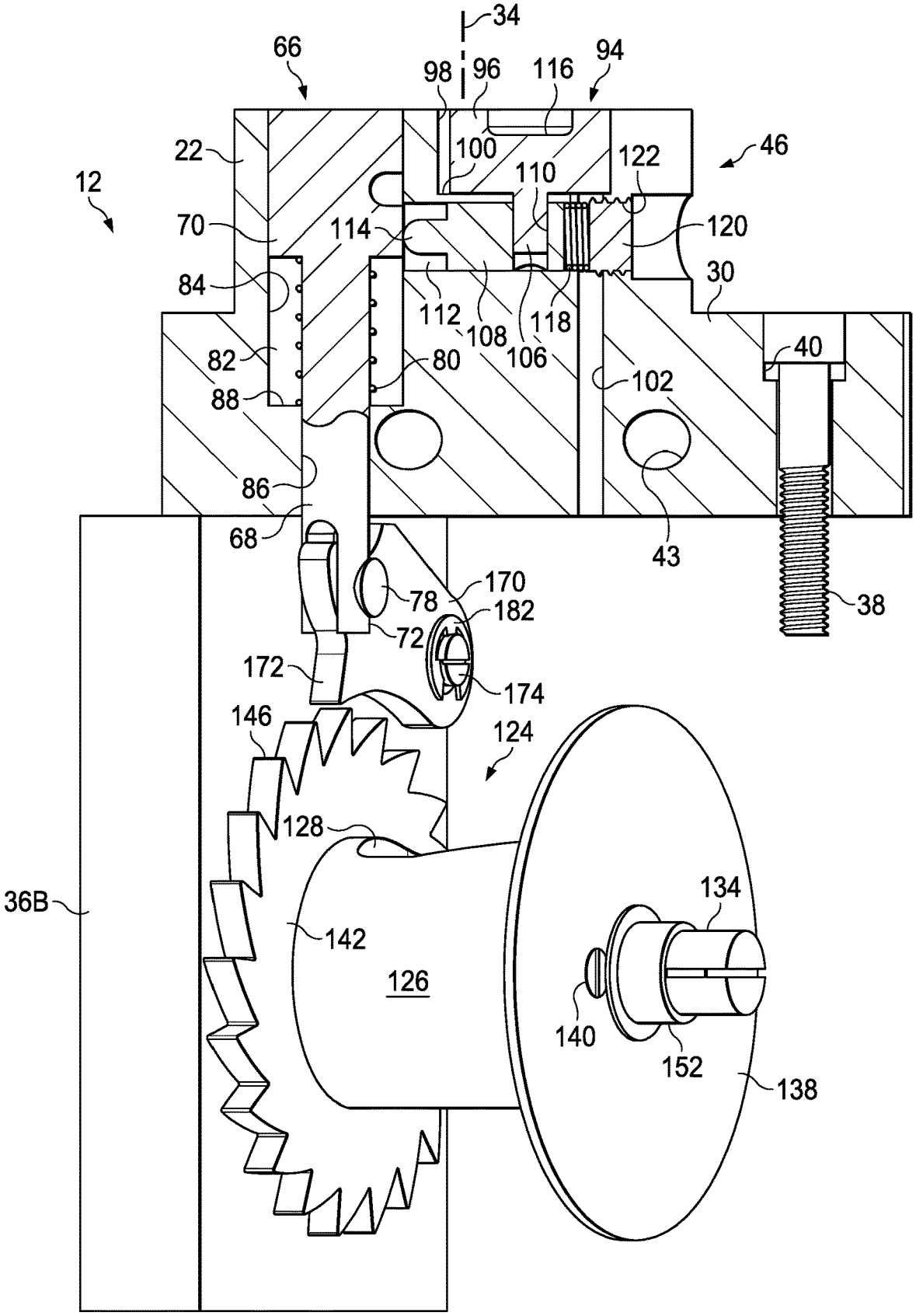
FIG. 9 is a perspective view of the mooring device of FIG. 4 with the mooring head assembly shown in cross section, wherein the reel assembly of the mooring device is shown in an unlocked condition.

As can be seen in FIG. 8, the aperture 82 includes an upper portion 84 having a large width or diameter and a lower portion 86 with a smaller width or diameter. The lower portion 86 defines a radially inward projecting annular shoulder 88 within the aperture 82. As shown in FIG. 9, the lower portion 86 of aperture 82 is sized and configured to closely receive the narrow rod 68 of the pawl actuator 66 but allow it to freely move within the lower portion of the aperture 82. Likewise, the larger upper portion 84 of the aperture 82 is sized and configured to closely receive the head 70 of the pawl actuator 66 but provide sufficient space to allow it to freely move therein when the pawl actuator is moved between the fully depressed and released positions. The lower end of spring 80 abuts against the shoulder 88 at the junction of the upper and lower portions 84, 86 so that the spring 80 is compressed and acts against the head 70 of the pawl actuator 66 and the shoulder 88 within aperture 82.

In some embodiments, the head or button 70 may be provided with a series of flutes or small passages 90 that are circumferentially spaced apart around the perimeter of the head 70. The flutes allow the passage of water past the head 70 into the aperture 82. One or more weep holes 92 that extend through the shoulder 88 and through the mooring head base 30 are also provided to allow water to drain so that water does not collect within aperture 82.

The mooring head assembly 46 also includes an actuator lock 94 (FIG. 9). The actuator lock 94 includes a lock head or button 96 that is received within lock head channel or chamber 98 (FIG. 8) formed in the upper surface of mooring head 22. The actuator lock 94 is accessible from the exposed upper surface of the mooring head 22. In the embodiment shown FIG. 9, the lock button 96 is generally cylindrical in shape having a circular transverse cross section. A recess or indentation 99 may be provided in the upper surface of the button 96 to facilitate manipulating the button 96 to slide it within the channel 98. The channel 98 is configured as a stadium-shaped channel having opposite semicircular ends and a rectangular midsection that is sized and configured to closely receive the circular lock head 96 but allow the free linear movement of the lock head 96 within the channel 98.

As shown in FIG. 8, a stadium-shaped annular shoulder 100 is formed in the bottom of the channel 98 upon which the lower surface of the lock head 96 rests. The shoulder 100 is provided with one or more weep holes 102 that extend through the shoulder 100 and through the mooring head base 30 to allow water to drain from the channel 98. The inner perimeter of the shoulder 100 of the channel 98 defines a lower opening or slot 104 that receives a lock neck 106 that extends from the lower end of the lock head 96 and projects through the slot 104. The channel 98 is configured to allow the linear movement of the neck 106 within the slot 104 as the lock button 96 is moved within channel 98.

The lower end of the neck 106 is threaded and projects below the slot 104 and engages a lock shuttle body 108. The lock shuttle body 108 is configured generally as a cylinder and has a threaded aperture 110 in the side of the cylindrical body, with the threaded neck 106 threading into the threaded aperture 110. The lock button 96 may be provided with engagement portions 111, such as spanner pins for use with a spanner wrench, to facilitate threading the neck 106 into the aperture 110. The lock shuttle body 108 is received within a lateral passage or slide chamber 112 formed in the mooring head 22. The chamber 112 extends from an exterior sidewall of the mooring head 22, communicating with the slot 104, and communicating with and terminating at its inner end at wall of the upper portion 84 of the pawl actuator aperture 82. The chamber 112 is configured for receiving the lock shuttle body 108 so that it can be slid or moved linearly within the passage 112 between engaged and disengaged positions in response to the lock head 96 being moved within lock head channel 98.

The forward end of lock shuttle body 108 facing the pawl actuator aperture 82 may have a projecting pin or tip 114 for engaging the head 70 of the pawl actuator 66. The head 70 of the pawl actuator 66 is provided with a corresponding side aperture 186 formed in the sidewall of the cylindrical head 70 that aligns with the pin or tip 114. The aperture 116 is sized and configured to receive the tip 114 of the lock shuttle body 108. The end of the tip 114 may be curved or rounded to facilitate sliding along the outer perimeter of the head 70 and to facilitate smooth entry into the side aperture 116.

A biasing member 118 positioned within the passage 112 and abuts at its forward end against the rearward end of the shuttle body 108 to urge it forward toward the pawl actuator aperture 82. The biasing member 118 may be in the form of a helical coiled compression spring. A threaded insert or plug 120 that threads into a threaded portion 122 of passage 112 abuts against the rearward end of the spring 118 to retain the spring 118 and keep it under compression so that it urges the shuttle body 108 forward.

The lock button 96, lock shuttle body 108, and threaded insert 120 may each be formed from corrosion resistant metal materials, such as stainless steel, aluminum, brass, etc. In certain applications, the lock button 96, lock shuttle body 108, and threaded insert 120 are formed from non-metal materials. These may include durable plastic or polymeric materials, such as an acetyl homopolymer (e.g., DELRIN® acetyl homopolymer). The spring 118 for the lock shuttle body 108 may be formed from stainless steel, such as 316 stainless steel.

Figure 10:
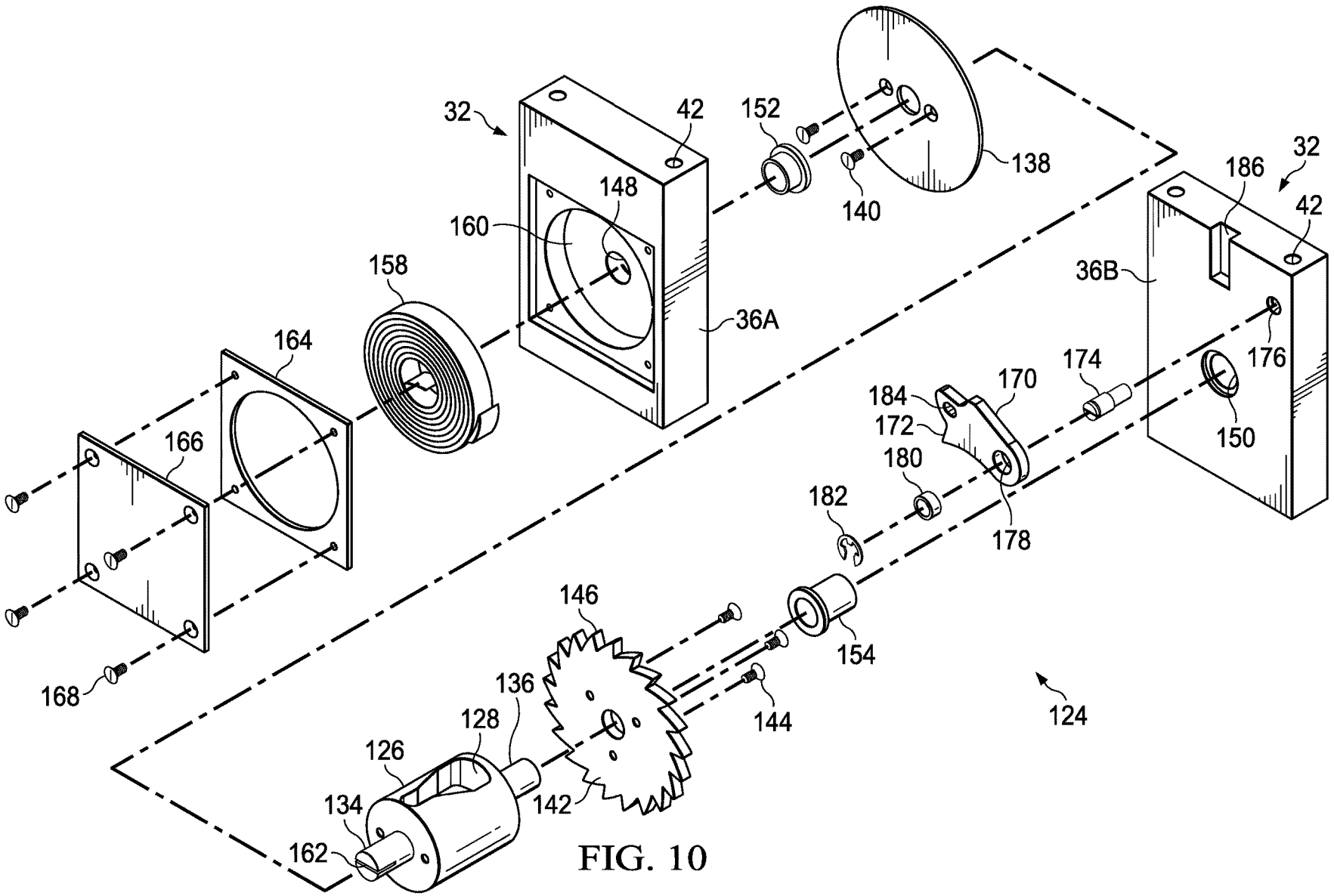
FIG. 10 is a perspective view of the reel assembly of the mooring device of FIG. 4, shown with components of the reel assembly exploded apart.

Referring to FIG. 10, a reel assembly 124 of the mooring line device 12 is shown with the components of the reel assembly exploded apart. The reel assembly 124 is coupled to the reel assembly housing 32 formed by the housing members 36A, 36B. The reel assembly 124 is used to take up the flexible mooring line 20 that is passed through the line aperture 62 of the mooring head 22. The reel assembly 124 includes a rotatable spool 126 for winding the mooring line 20 upon the spool 126. The spool 126 is generally cylindrical in shape for rotating about a central axis and is sized and configured to take up or wind a selected amount of mooring line 20 to be used with the mooring device 12.

Figure 12:
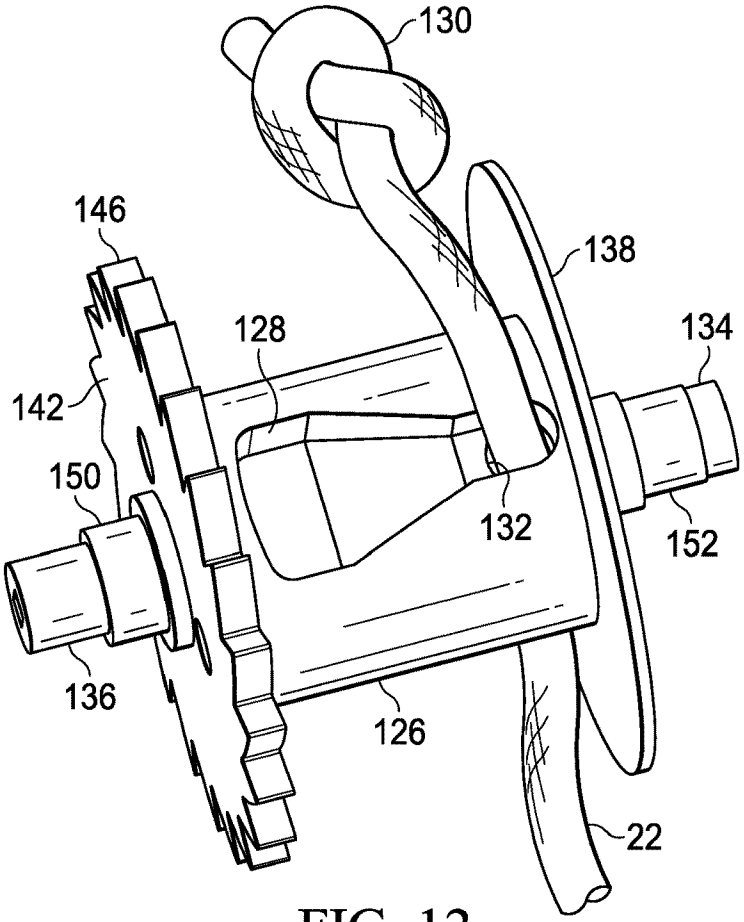
FIG. 12 is a perspective view of the spool and ratchet wheel of FIG. 11, shown with a mooring line passed through a spool aperture and cavity, with the mooring line knotted on one end.
Figure 11:
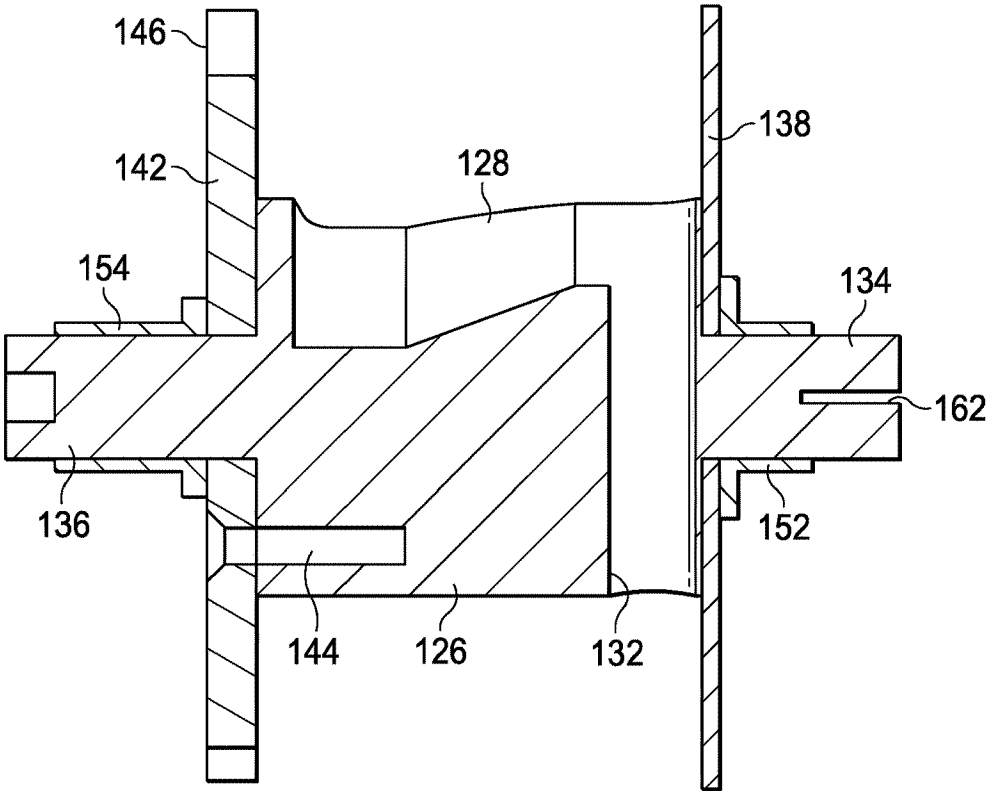
FIG. 11 is an elevational cross-sectional view of a spool and ratchet wheel of the reel assembly of FIG. 10.

As shown in FIGS. 11 and 12, the spool 126 may be provided with a recess or cavity 128 that is sized and configured for receiving a knot 130 (e.g., overhand knot) formed in the end of the line 20 when the line is coupled to the spool 126. The recess 128 allows the knot 130 to lie within the cavity 128 so that it does not project significantly beyond the outer surface of the spool 126 to take up space reel space upon the spool 126. The spool 126 has a spool aperture or passage 132 that extends from the surface of the spool 126 and communicates with the recess 128 for passing the end of the line 20 through the spool 126. The knot 130 is sized so that it cannot pass through the aperture 132 to thereby securely hold the line 20 upon the spool 126 of the reel assembly 124.

The spool 124 includes opposite shafts 134, 136 extending from either side of the spool 124 that are coaxial with spool 124 for rotatably supporting the spool 124. The spool 124 and shafts 134, 136 may be formed or machined from a single piece of material or may be formed from separate pieces. The spool 124 and shafts 134, 136 may each be formed from corrosion resistant metal materials, such as stainless steel, aluminum, brass, etc. In certain applications, the spool 124 and shafts 134, 136 are formed from non-metal materials. These may include durable plastic or polymeric materials, such as an acetyl homopolymer (e.g., DELRIN® acetyl homopolymer).

A circular, disk-shaped spool end plate 138 is mounted over the shaft 134 and secured to the end of the spool 124 through fasteners 140. Similarly, a circular, disk-shaped ratchet wheel 142 is mounted over the shaft 136 and is secured or coupled to the end of the spool 124 through fasteners 144. The end plate 138 and ratchet wheel 142 are coaxial with the spool 124 and rotate together.

The ratchet wheel 142 has a plurality of projecting teeth 146 about its perimeter. The teeth 146 are uniformly and circumferentially spaced apart. In the embodiment shown, the teeth 146 are all inclined teeth that are all incline in the direction of rotation that corresponds to the unwinding of line on the spool 124.

The spool 124, with the end plate 136 and ratchet wheel 142, is mounted to the reel assembly housing members 36A, 36B, which are each provided with spool shaft holes 148, 150. The shaft holes 148, 150 are sized and configured for receiving spool shaft bushings 152, 154, respectively.

The bushings 152, 154, in turn, receive the spool shafts 134, 136, respectively, to facilitate free rotation of the shafts 134, 136 within the shaft holes 148, 150 so that the spool 124 can be freely rotated. In some embodiments, the bushings 152, 154 may be porous metal bushings that are impregnated with a lubricating oil. This facilitates self-lubrication of the bushings and adds resistance to corrosion from salt water and the like. The bushings 152, 154 may also be coated with friction reducing coatings, such as Teflon® fluoropolymers and the like. In certain embodiments, all or a portion of the bushings 152, 154 may be formed from non-metal materials. Such non-metal materials may include plastic or polymeric materials, such as polytetrafluoroethylene (PTFE), acetyl homopolymer (e.g., DELRIN® acetyl homopolymer), etc. While ball bearings and roller-type bearings may be used in some applications instead of the bushings 152, 154, such bearings may be prone to corrosion and failure in marine-type applications, and thus may be unsuitable in some applications.

As shown in FIG. 10, a reel spring or biasing element 158 in the form of a spiral torsion spring is received in a spring recess or cavity 160 formed in the outer wall of housing member 36A. The spring 158 may be that formed from a thin, flat band of steel spirally wound upon itself so that one end of the spring is located at its center and the other end is located along its outer perimeter. The spring cavity 160 is sized and configured to receive the spring 158. The center end of the spring 158 is fixed to the shaft 134, such as through slot 162 formed in shaft 134. The outer end of the spring 158 is fixed to the housing member 36A, such as at the wall of cavity 160. The reel spring 158 exerts torsional force or torque upon the spool 124 to facilitate rotating the spool for automatically taking up the mooring line 20 on the spool 124. A gasket 164 and spring cover 166 are mounted to the housing member 36A using fasteners 168 to cover and seal the cavity 160 so that the spring 158 is enclosed and protected within the cavity 160.

The reel assembly 124 further includes a reel pawl 170 formed as a pawl body having a ratchet engagement portion or projection 172 that engages the projecting teeth 146 of the ratchet wheel 142. The pawl 170 is pivotally coupled to the on the interior side of the housing member 36B of the reel assembly housing 32. The ratchet engagement portion 172 is configured for engagement with the projecting teeth 146 to prevent rotation of the ratchet wheel 142 and spool 126 when in a locked position. The ratchet engagement portion 172 disengages from the projecting teeth 146 to allow rotation of the ratchet wheel 142 and spool 126 in an unlocked position. A reel pawl stud 174 threaded at one end is coupled the housing member 36B through threaded aperture 176. The pawl 170 is pivotally mounted to the pawl stud 174 through pawl stud aperture 178, which receives a reel stud bushing 180 that is mounted over the stud 174 to allow the pawl 170 to pivot about a pivot point coinciding with the longitudinal axis of the stud 174. A keeper or retaining clip 182 is used to retain the pawl on the pawl stud 174.

The materials of the reel assembly 124, such as the spool 126, ratchet wheel 142, torsion spring 162, pawl 170, and pawl stud 174, may be made of a strong, durable corrosion resistant metal material, such as stainless steel (e.g., 316 stainless). The thickness of the ratchet wheel 142 and pawl 170 may correspond or be the same or similar to one another. The reel stud bushing 180 may be a porous metal that is impregnated with oil for lubrication and corrosion resistance.

Spaced apart from the pawl stud aperture 178 and located above the engagement portion 172 of the pawl body 170 is an aperture 184 for coupling the pawl 170 to the pawl actuator 66 (FIG. 6). A slot or clearance 186 formed in the upper end of the housing member 36B on its interior side allows the elongated rod 68 of the pawl actuator 66 to extend into the reel assembly housing 32 so that the arms 72 pawl actuator rod 68 locate on either side of the aperture 184 of the pawl 170. The pawl 170 is coupled to the pawl actuator 66 through the pin or post 74, which is received within the aperture 184. The pin 74 forms a bearing surface so that pawl 170 can rotate about the pin 74 as it is pivoted about the stud 174.

In operation, as shown in FIG. 1, the mooring line device 12 is coupled to the dock 14 with the upper surface of the mooring head 22 being flush or level or substantially flush or level with the surrounding surface 16 of the deck planking 18. As discussed previously, although the mooring line device 12 is shown being used on a dock, it could also be used on a boat or watercraft for mooring to a dock or another boat or other structure. When the mooring line 20 is fully retracted and stored on the mooring line device 12, the line anchor 48 is received in line aperture 62. In this position, the upper surface of the line anchor 48 and lock button 96 of the actuator lock 94 are also flush or level or substantially flush or level with the mooring head 22 and/or plank surface 16. Initially, there may be enough torque exerted by the reel spring 158 on the spool 126 of the reel assembly 124 to place the line 20 stored on the spool 126 under tension when fully retracted so that the line anchor 48 is retained in place within the line aperture 62. The frustoconical line anchor 48 keeps the rope or mooring line 20 from being fully retracted through line aperture 62 even when it is under such tension.

Referring to FIG. 9, when the mooring line 20 is fully retracted, the pawl actuator 66 may be in the released or disengaged position so that the tip 114 of the locking shuttle body 108 rests against the head 70 of the pawl actuator 66. The upper surface of the pawl actuator head or button 70 is also flush or level or substantially flush or level with the mooring head 22 and/or plank surface 16 when in such released or disengaged position. The pawl actuator 66 is biased by spring 80 to this released position. When in this position, the rod 68 of the pawl actuator 66 coupled to the pawl 170 will lift the pawl engagement portion 172 of the pawl 170 away from the teeth 146 of the ratchet wheel 142 so that the ratchet wheel 142 is disengaged from the pawl 170 and the ratchet wheel 142 and spool 126 can be freely rotated.

With the pawl 170 disengaged from the ratchet wheel 142, the line anchor 48 can be pulled out of the line aperture 2 with a length of line 20 being unreeled from the reel assembly 124, as shown in FIG. 2. Unreeling the line 20 from reel assembly 124 causes the reel spring 158 to wind, thus storing rotational energy that is imparted to the reel assembly spool 126.

When enough line has been unreeled to perform the desired mooring activity, the pawl actuator button 70 of the pawl actuator 66 is depressed. This causes the pawl actuator head 70 to move downward through aperture 84, forcing and pivoting the pawl 170 to an engaged position. The pin 114 of lock shuttle body 108, which is forced by spring 118 towards the pawl actuator head 70, will slide along the outer surface of the head 70 until it reaches the side aperture 116, which is aligned with the pin 114. Upon reaching the side aperture 116, the pin 114 is forced into aperture 116 by the spring 118 so that further downward movement of the pawl actuator 66 is prevented and so that the pawl actuator 66 is locked in place. This is shown more fully in FIG. 13.

Figure 13:
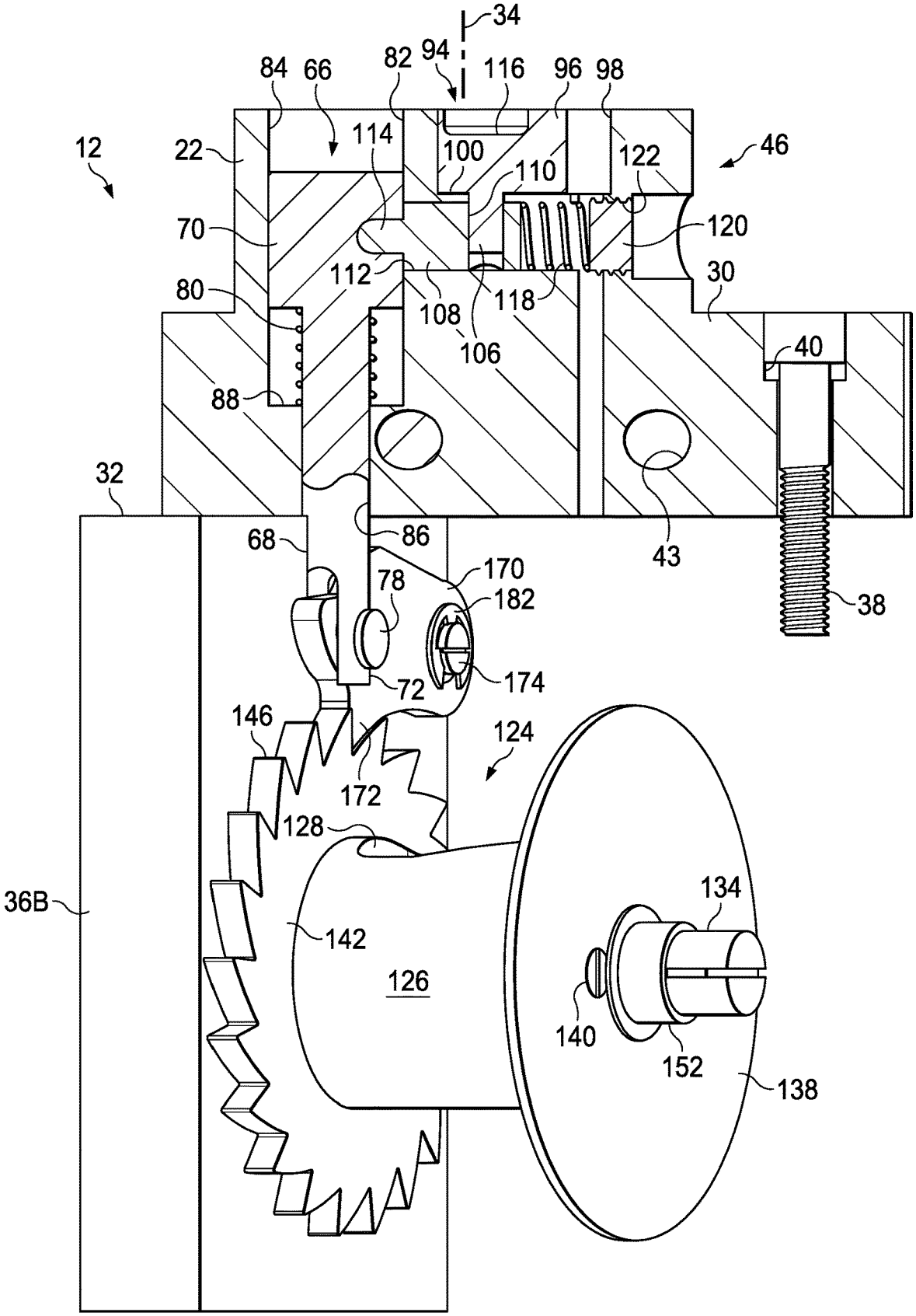
FIG. 13 is a perspective view of the mooring device of FIG. 9 wherein the reel assembly of the mooring device is shown in a locked condition.

As the pawl actuator 66 is moved to this locked position, the rod 68 coupled to the pawl 170, forces and pivots the pawl 170 downward so that the engagement portion 172 of the pawl 170 engages one of the teeth 146 of the ratchet wheel 142. As shown in FIG. 13, with the pawl 170 engaged with the ratchet wheel 142 in this manner, further rotation of the ratchet wheel 142 and spool 126 is prevented so that no further line 20 may be unreeled from the reel assembly 124. The mooring line 20 is thus securely held in place by the reel assembly 124 of the mooring device 12 to facilitate mooring.

After the mooring operation is complete and the line 20 is no longer needed, the actuator lock 94 is disengaged from the pawl actuator 66. This is achieved by moving the lock button 96 within the channel 98 away from the pawl actuator 66. Movement of the lock button 96 will cause the neck 106 to move the lock shuttle body 108 away from the head 70 of the pawl actuator 66 so that the tip 114 of shuttle body 108 is withdrawn from aperture 116 to unlock the pawl actuator 66.

When the pawl actuator 66 is unlocked, the spring 80 will automatically force the pawl actuator 66 to the released or disengaged position. This will cause the pawl actuator 66 to lift or pivot the pawl 170 upward so that the pawl engagement portion 172 is disengaged from the rachet teeth 146 of the ratchet wheel 142. When the pawl 170 is disengaged from the ratchet wheel 142, the torsion spring 158 of reel assembly 124 will exert torque on the spool 126 causing the spool 126 to rotate or wind the mooring line 20 back through the line aperture 62 until the line anchor 48 at the end of the line 20 is received and seated in the line aperture 62.

The mooring line device 12 has many advantages over the prior art. The mooring line device provides a way to easily store a mooring line that is out of the way and unobtrusive. Because it is flush with the deck or other mounting structure it does not constitute a tripping hazard. When not in use, the mooring line device is out of the way and does not take up space so that the area directly over the mooring line device can be used for other purposes.

Another beneficial feature is that the mooring line device is securely anchored in place using a dock substructure to mount the mooring device. With a conventional cleat, the cleat is typically mounted to the surface of the deck of dock, which does not provide as high a degree of strength compared to the dock substructure. Furthermore, with a conventional cleat, the fasteners used to mount the cleat necessarily must penetrate the deck or plank to which the cleat is mounted. Water may tend to seep through the holes for such fasteners, particularly when it is a level or horizontal deck or plank that is prone to collecting water on its surface, deteriorating the wood around the fasteners or causing corrosion of the fasteners themselves, so that the cleat may eventually fail or become loose.

With the mooring line device of the invention, no fasteners are used in the decking or plank with which the head of the mooring line device projects to mount the mooring line device. Indeed, the fasteners used for securing and mounting the mooring line device are covered and protected by the decking or plank where the mooring line device is located. This also makes the mooring line device less accessible, making tampering with and removal of the device more difficult, since the decking or planking where the mooring device is located must first be removed before the mooring line device can be accessed.

The mooring line device is easily operated and saves time during mooring operations. The desired length of line can be quickly supplied merely by pulling the line off the reel assembly of the mooring device. Excess line remains stored on the device and out of the way. There is no need to manually uncoil the desired length of rope and tie off or store any excess, as required with conventional cleats. The automatic spring retraction of the mooring line on the reel assembly provides a quick and effortless means for storing the rope after use. There is no need for manually recoiling the rope, as with conventional mooring lines and cleats.

The mooring device mechanisms can be quickly locked and unlocked with ease to provide the desired amount of mooring line, securing the mooring, and quickly retracting the mooring line after use. Because a pawl and ratchet wheel are used, there is no need to align the pawl and ratchet wheel to a locked position. The pawl will automatically fall into place for engagement with the ratchet teeth as the ratchet wheel is rotated.

The mooring line device is durable and provides a secure hold during mooring operations. In an example of a suitable mooring line device for use with boats or watercraft of 40 feet or less, a mooring device with a ratchet wheel having those characteristics set forth in Table 1 below may be used.

TABLE 1

| | |
|---|---|
| Circular Pitch | 1 to 6 inches |
| Turning Moment Acting on Shaft | 5,000 to 20,000 in · lbs |

TABLE 1-continued

| | |
|---|---|
| Distance to Shaft Center | 1.5 to 5 inches |
| Rope Breaking Stress | ≥2500 |
| Safety Factor | ≥25% |
| Thickness of Ratchet Gear | 0.125 to 0.375 inch |
| Safe Stress | ≥1500 psi |
| Number of Teeth | 15 to 35 |
| Fixed Factor | ≥15 |
| Angle Between Teeth | 10 to 20 degrees |

Additionally, in an example of a suitable mooring line device for use with boats or watercraft of 40 feet or less, a mooring device with a torsion spring having those characteristics set forth in Table 2 below may be used.

TABLE 2

| | |
|---|---|
| Torque | 5 to 15 in · lbs |
| Arbor Size | 0.375 to 1 inch |
| Number of Turns | 10 to 30 |
| Spring O.D. | 2 to 5 inch |
| Spring Width | 0.375 to 1 inch |

The following example better serves to illustrate the invention.

EXAMPLE

Example 1

A test unit of mooring device having the following characteristics set forth in Table 3 was tested.

TABLE 3

| Ratchet Wheel | |
|---|---|
| Circular Pitch | 4 inches |
| Turning Moment Acting on Shaft | 12,000 in · lbs |
| Distance to Shaft Center | 3 inches |
| Rope Breaking Stress | 3240 lbs |
| Safety Factor | 25% |
| Thickness of Ratchet Gear | 0.25 inch |
| Safe Stress | 2500 psi |
| Number of Teeth | 24 |
| Fixed Factor | 20 |
| Angle Between Teeth | 15 degrees |
| **Torsion Spring** | |
| Torque | 8.3 in · lbs |
| Arbor Size | 0.625 inch |
| Number of Turns | 10 to 30 |
| Spring O.D. | 3 inch |
| Spring Width | 0.5 inch |

The mooring line device was subjected to more than 2,000 operations without malfunction. Additionally, in a pull test, the unit easily handled a pulling force in excess of 3,000 lbs, at which point the rope failed without damaging the unit or compromising further performance.

While the invention has been shown in some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A mooring line device comprising:

a housing having a mooring head that is configured for projecting through an opening or recess of a mounting structure so that an upper surface of the mooring head does not project from an outer surface of the mounting structure, the mooring head having a line aperture formed therein;

a reel assembly coupled to the housing and positioned below the mooring head that is configured to take up a flexible mooring line that is passed through the line aperture of the mooring head, the reel assembly comprising:

a rotatable spool for winding the mooring line upon the spool;

a ratchet wheel being coaxial with and coupled to the spool so that the ratchet wheel and spool rotate together, the ratchet wheel having projecting teeth circumferentially spaced apart about the perimeter of the ratchet wheel;

a biasing element coupled to the spool for exerting torque upon the spool to facilitate rotating the spool for taking up line on the spool;

a pawl having a ratchet engagement portion for engaging the projecting teeth of the ratchet wheel, the pawl being pivotally coupled to the housing so that pawl pivots about a pivot point between a locked position wherein the ratchet engagement portion engages one of the projecting teeth to prevent rotation of the ratchet wheel and spool, and an unlocked position wherein the ratchet engagement portion disengages from the projecting teeth to allow rotation of the ratchet wheel and spool; and a mooring head assembly comprising:

a line anchor that is accessible from the upper surface of the mooring head for securing to an end of the line, the line anchor being configured so that the line anchor is received in at least a portion of the line aperture so that the line anchor does not project from the upper surface of the mooring head;

a pawl actuator that is accessible from the upper surface of the mooring head, the pawl actuator being movable between first and second positions so that the pawl actuator engages the pawl so that the pawl is pivoted to the locked position when the pawl actuator is in the first position, and the pawl is pivoted to the unlocked position when in the pawl actuator is moved to the second position;

a biasing device for biasing the pawl actuator to one of the first and second positions; and an actuator lock that is accessible from the upper surface of the mooring head, the actuator lock being movable between an engaged and disengaged position wherein the actuator lock engages pawl actuator when moved to the engaged position to retain the pawl actuator in one of the first and second positions.

2. The mooring line device of claim 1, wherein:

the line aperture has a frustoconical recessed portion and wherein the line anchor is configured with a corresponding frustoconical body portion that is closely received in the frustoconical recessed portion when the line anchor is seated therein.

3. The mooring line device of claim 1, wherein:

the mounting structure comprises at least one of a dock, a pier, a deck, a boat, a gunwale, a bow, and a transom.

4. The mooring line device of claim 1, wherein:

the housing includes a reel assembly housing located below the mooring head, a reel assembly being coupled the reel assembly housing; and wherein the reel assembly housing is coupled to the mounting structure.

5. The mooring line device of claim 1, wherein:

the mounting structure includes an outer face member having the outer surface, the outer face member formed with a mooring head opening configured for closely receiving the mooring head of the housing.

6. The mooring line device of claim 1, wherein:

the biasing device biases the pawl actuator to the second position.

7. The mooring line device of claim 1, wherein:

the pawl actuator includes an actuator lock recess that receives the actuator lock when the actuator lock engages the pawl actuator when in the engaged position.

8. The mooring line device of claim 1, wherein:

the actuator lock is biased by a biasing member toward the engaged position.

9. The mooring line device of claim 1, wherein:

the spool includes a recess sized and configured for receiving a knot of the line when the line is coupled to the spool.

10. The mooring line device of claim 1, wherein:

the spool includes a spool aperture for passing the line through the spool.

11. The mooring line device of claim 10, wherein:

the spool includes a spool recess that is in communication with the spool aperture, the spool recess being is sized and configured for receiving a knot of the line when the line is passed through the spool aperture for coupling the line to the spool.

12. The mooring line device of claim 1, wherein:

the line anchor, pawl actuator, and actuator lock are each received in corresponding recesses formed in the upper surface of the mooring head.

13. The mooring line device of claim 1, further comprising:

a mooring line having a diameter of ½ inch or less that is coupled at one end to the spool and to the line anchor at the other end.

14. The mooring line device of claim 1, wherein:

the line anchor has a recess to facilitate manually grasping the line anchor.

15. The mooring line device of claim 14, further comprising:

a light provided in the recess of the line anchor.

16. The mooring line device of claim 11, wherein:

the upper surface of the mooring head has a maximum width or transverse dimension of 5 inches or less.

17. A mooring line device comprising:

a mooring line having a diameter of ½ inch or less;

a housing having a mooring head that is configured for projecting through an opening or recess of a mounting structure so that an upper surface of the mooring head does not project from an outer surface of the mounting structure, the mooring head having a line aperture formed therein, the upper surface of the mooring head having a maximum width or transverse dimension of 5 inches or less, the housing including a reel assembly housing located below the mooring head, the reel assembly housing being coupled to the mounting structure;

a reel assembly coupled to the reel assembly housing and positioned below the mooring head, the reel assembly being configured to take up mooring line that is passed through the line aperture of the mooring head, the reel assembly comprising:

a rotatable spool for winding the mooring line upon the spool, the spool having a spool aperture for passing the mooring line through the spool and a spool recess that is in communication with the spool aperture, the spool recess being sized and configured for receiving a knot of the mooring line when the mooring line is passed through the spool aperture for coupling one end of the mooring line to the spool a ratchet wheel being coaxial with and coupled to the spool so that the ratchet wheel and spool rotate together, the ratchet wheel having projecting teeth circumferentially spaced apart about the perimeter of the ratchet wheel;

a biasing element coupled to the spool for exerting torque upon the spool to facilitate rotating the spool for taking up mooring line on the spool;

a pawl having a ratchet engagement portion for engaging the projecting teeth of the ratchet wheel, the pawl being pivotally coupled to the housing so that pawl pivots about a pivot point between a locked position wherein the ratchet engagement portion engages one of the projecting teeth to prevent rotation of the ratchet wheel and spool, and an unlocked position wherein the ratchet engagement portion disengages from the projecting teeth to allow rotation of the ratchet wheel and spool; and a mooring head assembly comprising:

a line anchor that is accessible from the upper surface of the mooring head for securing to an opposite end of the mooring line, the line anchor being configured so that the line anchor is received in at least a portion of the line aperture so that the line anchor does not project from the upper surface of the mooring head;

a pawl actuator that is accessible from the upper surface of the mooring head, the pawl actuator being movable between first and second positions so that the pawl actuator engages the pawl so that the pawl is pivoted to the locked position when the pawl actuator is in the first position, and the pawl is pivoted to the unlocked position when in the pawl actuator is moved to the second position;

a biasing device for biasing the pawl actuator to the second position; and an actuator lock that is accessible from the upper surface of the mooring head, the actuator lock being movable between an engaged and disengaged position wherein the actuator lock engages pawl actuator when moved to the engaged position to retain the pawl actuator in one of the first and second positions, the actuator lock being biased by a biasing member toward the engaged position; and wherein the line anchor, pawl actuator, and actuator lock are each received in corresponding recesses formed in the upper surface of the mooring head.

18. The mooring line device of claim 17, wherein:

the line aperture has a frustoconical recessed portion and wherein the line anchor is configured with a corresponding frustoconical body portion that is closely received in the frustoconical recessed portion when the line anchor is seated therein.

19. The mooring line device of claim 17, wherein:

the mounting structure comprises at least one of a deck, a gunwale, and a transom.

20. The mooring line device of claim 17, wherein:

the line anchor has a recess to facilitate manually grasping the line anchor.

* * * * *